US005456334A

United States Patent [19]

Brignac

[11] Patent Number: 5,456,334

[45] Date of Patent: Oct. 10, 1995

[54] SCAFFOLDING FOR USE BY BRICKLAYERS WHEN WORKING AT ELEVATED LOCATIONS

[76] Inventor: Louis Brignac, 127 Main Project Rd., P.O. Box 58, Schriever, La. 70395

[21] Appl. No.: 251,038

[22] Filed: May 31, 1994

[51] Int. Cl.[6] ..... E04G 1/14

[52] U.S. Cl. ..... 182/179; 182/152

[58] Field of Search ..... 182/179, 178, 182/152, 132, 224

[56] References Cited

U.S. PATENT DOCUMENTS

| | | | |
|---|---|---|---|
| 2,445,453 | 7/1948 | Pennington | 182/178 X |
| 3,850,264 | 11/1974 | Salinas | 182/179 X |
| 4,883,147 | 11/1989 | Davison | 182/152 X |

FOREIGN PATENT DOCUMENTS

| | | | |
|---|---|---|---|
| 1181035 | 6/1959 | France | 182/179 |
| 91863 | 8/1968 | France | 182/152 |

*Primary Examiner*—Alvin C. Chin-Shue

[57] ABSTRACT

A scaffolding for use by bricklayers when working at elevated locations comprising: a plurality of scaffolding components adapted to support planking for use by bricklayers when working at elevated locations; a scaffolding component comprising a central H-shaped member, the H-shaped member fabricated of a pair of vertically disposed hollow, external tubular members in spaced parallel relationship, each external vertical member having a plurality of holes extending therethrough in aligned pairs for adjustment purposes, a plurality of cross rods disposed in a horizontal orientation coupling the external vertical members; an adjustment foot for each external vertical member, each adjustment foot having a planar member positionable in a horizontal plane on the ground with an upstanding, external internal member positionable within the vertical external members and with apertures in aligned pairs adapted to align with the apertures of the vertical external members; and support legs with hinges coupling the first exterior vertical posts with the interior edges of the support legs, the support legs being formed in a rectangular configuration with pin holes in the exterior legs thereof adjacent the lower end with support feet having a horizontal plate and an interior vertical member with aligned apertures therethrough and a pin extending therethrough to vary the height of the support legs.

1 Claim, 4 Drawing Sheets

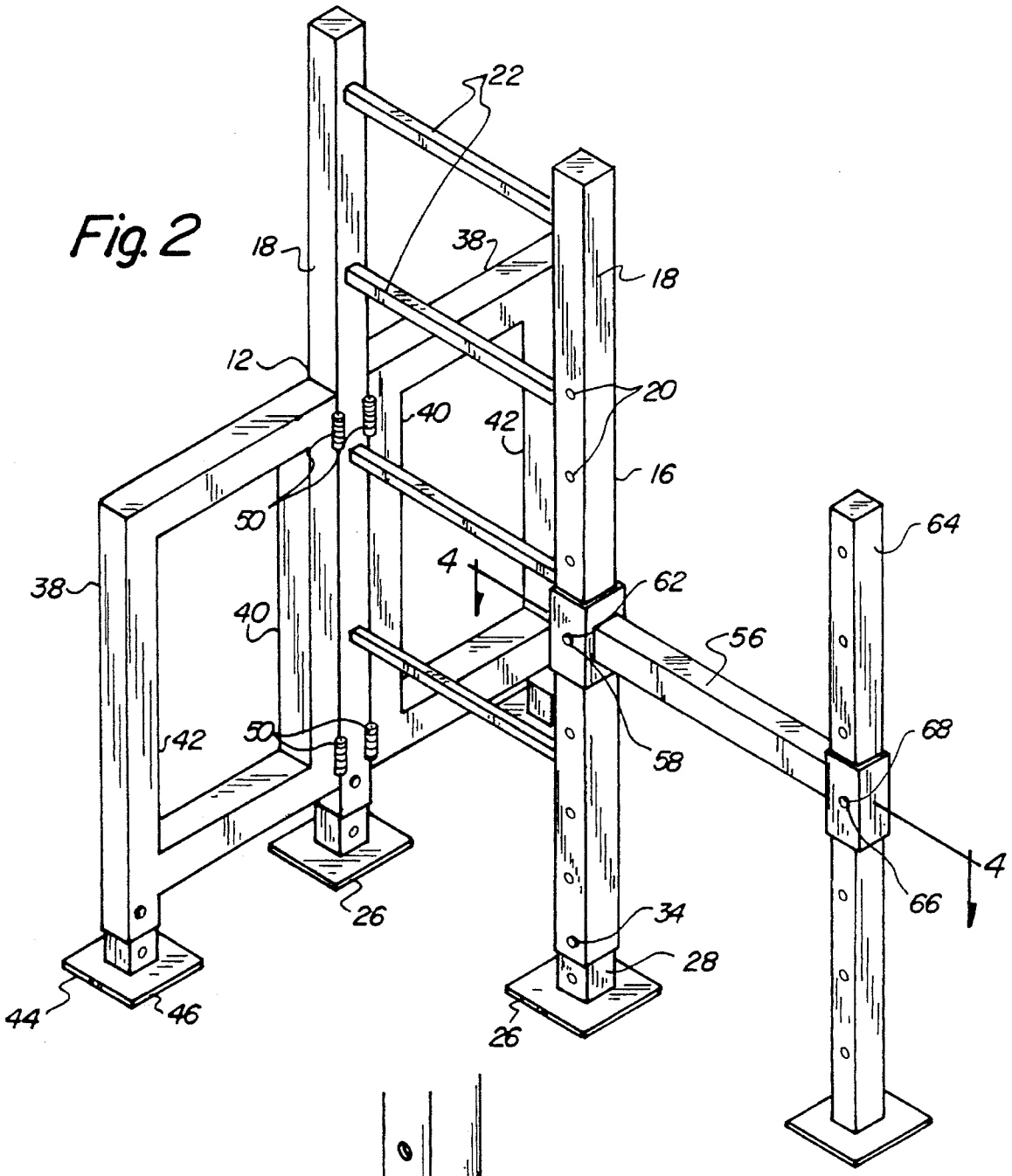
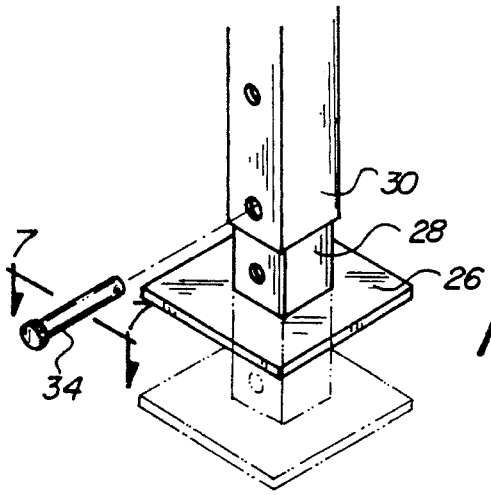
Fig. 3

SCAFFOLDING FOR USE BY BRICKLAYERS WHEN WORKING AT ELEVATED LOCATIONS

BACKGROUND OF THE INVENTION

1. Field of the Invention

The present invention relates to scaffolding for use by bricklayers when working at elevated locations and more particularly pertains to allow bricklayers to work at elevated locations through the use of scaffolding of a design rendering it simple to assemble, disassemble, move and use.

2. Description of the Prior Art

The use of scaffolding of a wide variety of construction is known in the prior art. More specifically, scaffolding of a wide variety of construction heretofore devised and utilized for the purpose of allowing workers to preform tasks at elevated locations through the use of scaffoldings of various designs and configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,145,032 to Puccinelli a mason's scaffold.

U.S. Pat. No. 4,997,062 to Pizzo discloses a swing scaffold.

U.S. Pat. No. 4,809,814 to St. Germain discloses a scaffolding.

U.S. Pat. No. 4,262,773 to Basham discloses a portable scaffold.

U.S. Pat. No. 3,791,486 to Marnoch discloses a scaffolding.

In this respect, the scaffolding for use by bricklayers when working at elevated locations according to the present invention substantially departs from the conventional concepts and designs of the prior art, and in doing so provides an apparatus primarily developed for the purpose of allowing bricklayers to work at elevated locations through the use of scaffolding of a design rendering it simple to assemble, disassemble and use.

Therefore, it can be appreciated that there exists a continuing need for new and improved scaffolding for use by bricklayers when working at elevated locations which can be used for allowing bricklayers to work at elevated locations through the use of scaffolding of a design rendering it simple to assemble, disassemble and use. In this regard, the present invention substantially fulfills this need.

SUMMARY OF THE INVENTION

In view of the foregoing disadvantages inherent in the known types of scaffolding of a wide variety of construction now present in the prior art, the present invention provides an improved scaffolding for use by bricklayers when working at elevated locations. As such, the general purpose of the present invention, which will be described subsequently in greater detail, is to provide a new and improved scaffolding for use by bricklayers when working at elevated locations and method which has all the advantages of the prior art and none of the disadvantages.

To attain this, the present invention essentially comprises a scaffolding for use by bricklayers when working at elevated locations comprising, in combination: a plurality of scaffolding components adapted to support planking for use by bricklayers when working at elevated locations; each of the scaffolding components comprising a central H-shaped member, the H-shaped member fabricated of a pair of vertically disposed hollow, external tubular members in spaced parallel relationship, each external vertical member having a plurality of holes extending therethrough in aligned pairs for adjustment purposes, a plurality of cross rods disposed in a horizontal orientation coupling the external vertical members into a ladder like configuration; an adjustment foot for each external vertical member, each adjustment foot having a planar member positionable in a horizontal plane on the ground with an upstanding, external internal member positionable within the vertical external members and with apertures in aligned pairs adapted to align with the apertures of the vertical external members; a pin positionable through aligned apertures of the interior vertical member and the exterior vertical member to vary the height of the H-shaped member; support assemblies being formed in a rectangular configuration with an internal vertical leg and an external vertical leg and horizontal legs therebetween and with apertures in the external legs adjacent the lower end with support feet having a horizontal plate positionable on the ground and an interior vertical member extending upwardly therefrom with aligned apertures therethrough; a pin extending through the apertures to vary the height of the support assemblies, the horizontal legs of the support assemblies being of a length essentially equal to the length of the cross rods of the H-shaped member; hinges coupling each internal, vertical posts with an associated external member of the H-shaped member; and a supplemental support post positionable in a vertical orientation with a horizontal support foot at the lower edge thereof, the supplemental vertical post being provided with plural aligned apertures for adjustment purposes and a cross piece having a C-shaped coupler at its internal end with aligned apertures positionable with aligned apertures of an external member of the H-shaped member for adjustment therebetween and a box shaped coupler for the passage of the supplemental support post therethrough with aligned apertures and a pin for passage therethrough to vary the elevational orientation thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scaffolding for use by bricklayers when working at elevated locations which have all the advantages of the prior art scaffolding of a wide variety of construction and none of the disadvantages.

It is another object of the present invention to provide a new and improved scaffolding for use by bricklayers when working at elevated locations which may be easily and efficiently manufactured and marketed.

It is further object of the present invention to provide a new and improved scaffolding for use by bricklayers when working at elevated locations which are of durable and reliable constructions.

An even further object of the present invention is to provide a new and improved scaffolding for use by bricklayers when working at elevated locations which are susceptible of a low cost of manufacture with regard to both materials and labor, and which accordingly are then susceptible of low prices of sale to the consuming public, thereby making such scaffolding for use by bricklayers when working at elevated locations economically available to the buying public.

Still yet another object of the present invention is to provide a new and improved scaffolding for use by bricklayers when working at elevated locations which provide in the apparatuses and methods of the prior art some of the advantages thereof, while simultaneously overcoming some of the disadvantages normally associated therewith.

Still another object of the present invention is to allow bricklayers to work at elevated locations through the use of scaffolding of a design rendering it simple to assemble, disassemble, move and use.

Lastly, it is an object of the present invention to provide new and improved scaffolding for use by bricklayers when working at elevated locations comprising: a plurality of scaffolding components adapted to support planking for use by bricklayers when working at elevated locations; a scaffolding component comprising a central H-shaped member, the H-shaped member fabricated of a pair of vertically disposed hollow, external tubular members in spaced parallel relationship, each external vertical member having a plurality of holes extending therethrough in aligned pairs for adjustment purposes, a plurality of cross rods disposed in a horizontal orientation coupling the external vertical members; an adjustment foot for each external vertical member, each adjustment foot having a planar member positionable in a horizontal plane on the ground with an upstanding, external internal member positionable within the vertical external members and with apertures in aligned pairs adapted to align with the apertures of the vertical external members; and support legs with hinges coupling the first exterior vertical posts with the interior edges of the support legs, the support legs being formed in a rectangular configuration with pin holes in the exterior legs thereof adjacent the lower end with support feet having a horizontal plate and an interior vertical member with aligned apertures therethrough and a pin extending therethrough to vary the height of the support legs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of one of the scaffolding components illustrated in FIG. 1.

FIG. 3 is an enlarged exploded perspective view of the lower portion of one of the support legs illustrating its adjustment capabilities.

The same reference numerals refer to the same parts through the various Figures.

DESCRIPTION OF THE PREFERRED EMBODIMENT

Figure 1:
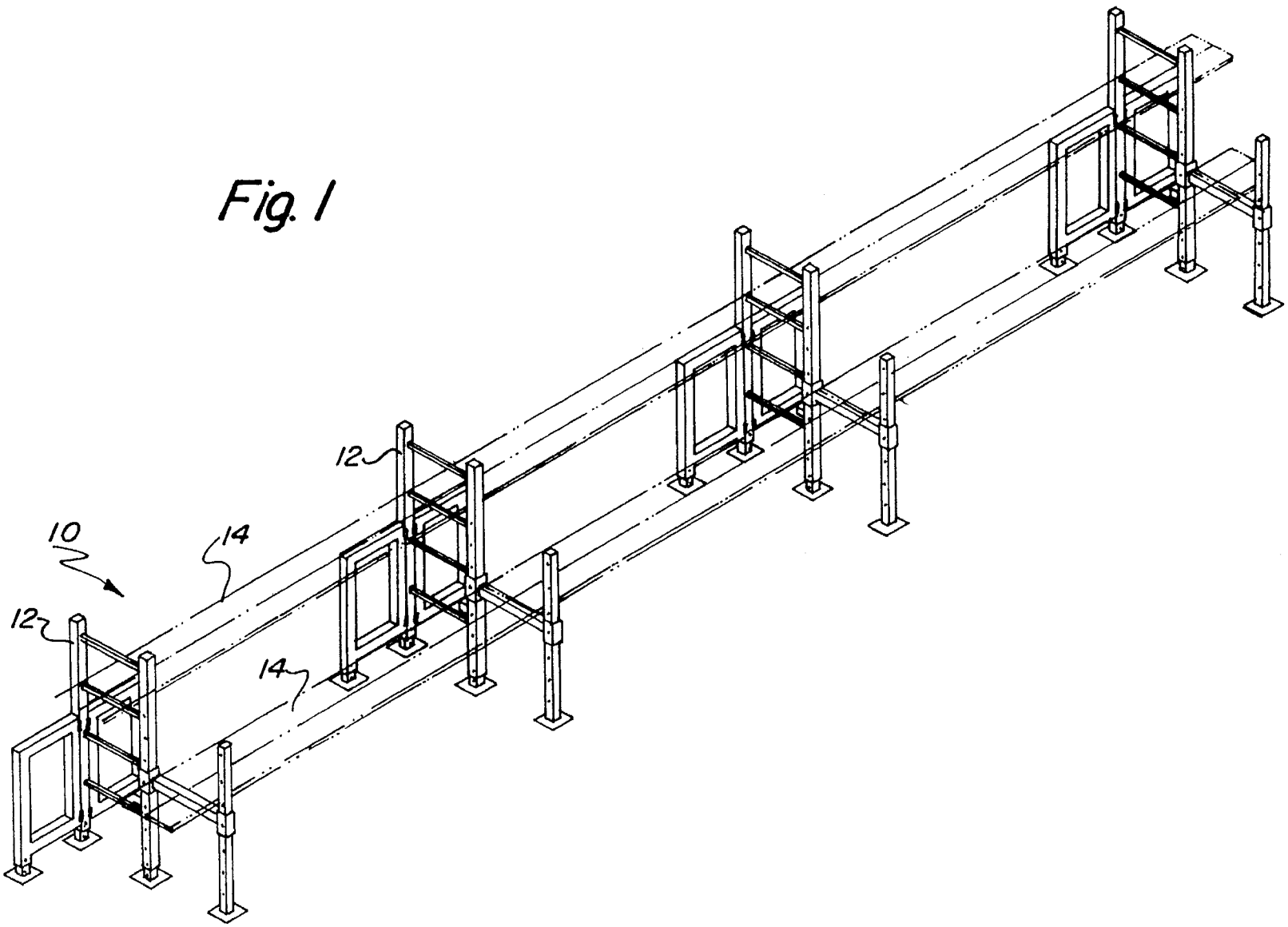
FIG. 1 is a perspective illustration of the preferred embodiment of the scaffolding for use by bricklayers when working at elevated locations constructed in accordance with the principles of the present invention.
Figure 4:
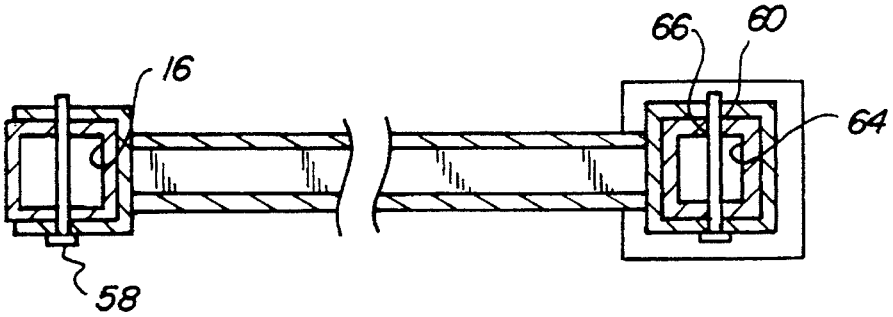
FIG. 4 is a cross-sectional view taken along line 4—4 of FIG. 2.
Figure 5:
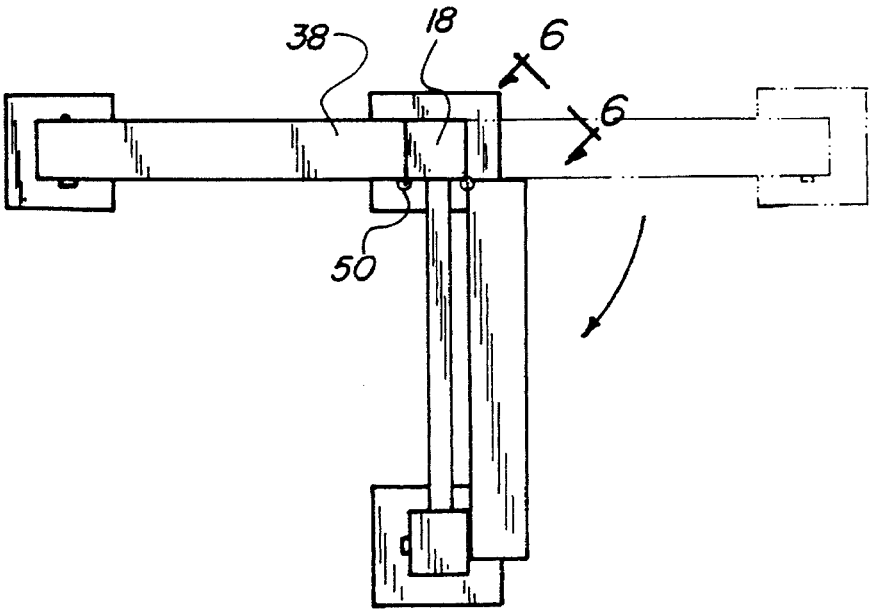
FIG. 5 is a top view of the scaffolding of FIG. 2 with one of the support legs folded and the other unfolded.
Figure 6:
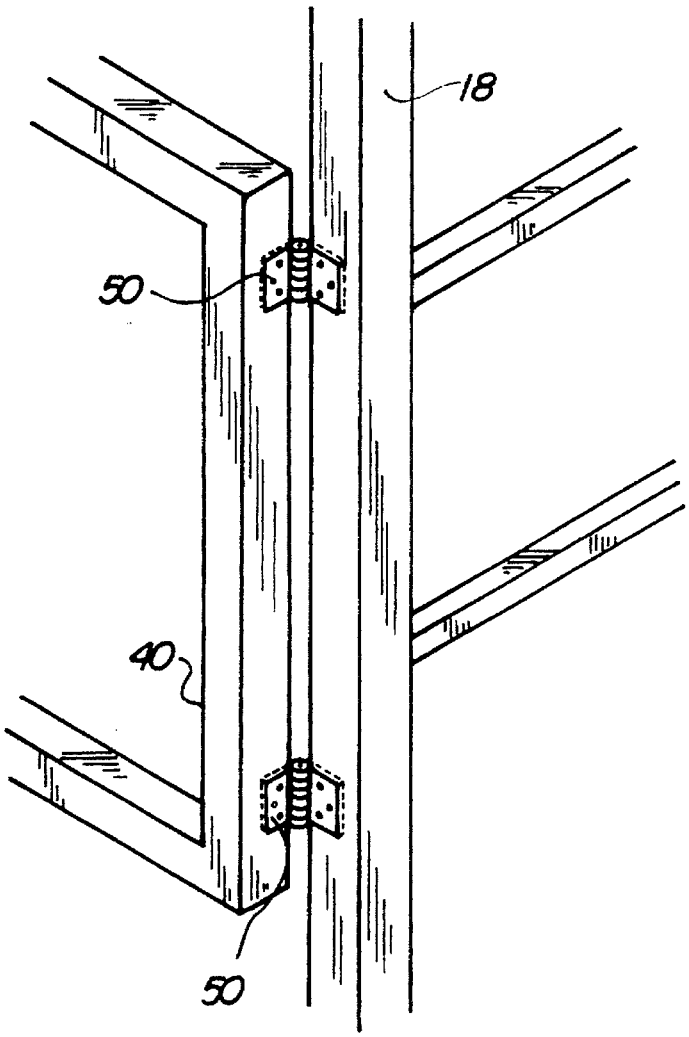
FIG. 6 is a perspective view taken along line 6—6 of FIG. 5.

With reference now to the drawings, and in particular to FIG. 1 thereof, the preferred embodiment of the new and improved scaffolding for use by bricklayers when working at elevated locations embodying the principles and concepts of the present invention and generally designated by the reference numeral 10 will be described.

The invention, the new and improved scaffolding for use by bricklayers when working at elevated locations is comprised of a plurality of components. In their broadest context, such components include scaffolding components, H-shaped member, adjustment feet, support assemblies, hinges, pins and a supplemental support post. Such components are specifically configured and correlated with respect to each other so as to attain the desired objective.

More specifically, the system 10 of the present invention has as its central component a plurality of scaffolding components 12. The scaffolding components together are adapted to support planking 14. The scaffolding and planking are for use by brick layers when working at elevated locations. Note FIG. 1.

Each of the scaffolding components has a central H-shaped member 16. The H-shaped member is fabricated of a pair of vertically disposed hollow external tubular members 18. Such members are held in spaced parallel relationship with each other. Each external vertical member has a plurality of holes 20. The holes extend therethrough in aligned pairs. Such holes are for adjustment purposes. In addition, a plurality of cross rods 22 are disposed in a horizontal orientation. Such cross rods are for coupling the external vertical member. Together the vertical members and cross rods form the X-shaped member, the central component of each scaffolding component.

Next provided is an adjustment foot for each external member. Each adjustment foot has a planar member 26. Each planar member is positionable in a horizontal plane on the ground. Each planar member has an upstanding internal member 28. Each such internal member is positionable within a vertical external member 30. In addition, each internal member is provided with apertures in aligned pairs. Such apertures are adapted to align with the apertures of the vertical external members.

A pin 34 is positionable through the aligned apertures of the internal vertical member and the external vertical member. The purpose of the pin is to insure the coupling between such members. The coupling is adapted to vary the height of the H-shaped member as a function of the apertures in alignment with the pin is inserted therethrough.

Stability for allowing the scaffolding components to stand is effected through a pair of support assemblies 38 for each H-shaped component. Each support assembly is formed in a rectangular configuration. This includes an internal vertical leg 40, and an external vertical leg 42 and horizontal legs therebetween. In addition, apertures are formed in the external legs adjacent to the lower ends. Support feet 44 are also provided. Such feet have a horizontal plate 46 positionable on the ground. They also have an interior vertical member extending upwardly therefrom. Aligned apertures in pairs are provided through the interior vertical members of the support assemblies. In addition, a pin extends through the apertures when aligned to vary the height of the support assemblies as a function of the apertures aligned when the pin is extended therethrough. The horizontal legs of the support assemblies are of a length essentially equal to the length of the cross rods of the H-shaped members.

Coupling between the support assemblies and H-shaped members is through hinges 50. Such hinges couple each external vertical post of the support assembly with an associated external member of the H-shaped member.

The embodiments disclosed above also include a supplemental support post 54. Such supplemental support post is positioned in a vertical orientation. Each includes a horizontal support foot at its lower end. A supplemental vertical post is provided with plural aligned apertures along a central extent thereof. In association with the supplemental support post is a cross piece 56. The cross piece has a C-shaped coupler at its internal end with aligned apertures 58. Such aligned apertures are positionable with aligned apertures 60 of an external member of the H-shaped member. Such apertures are for adjustment purposes. When a pin 62 extends through such apertures, the height is varied as a function of the apertures elected.

In addition, the cross piece has a box shaped coupler 64 at its opposite end for passage of the supplemental support post therethrough. Aligned apertures 66 and a pin 68 are provided for passage through the apertures. The aligned apertures elected will vary the elevational orientation of the cross piece.

Figure 7:
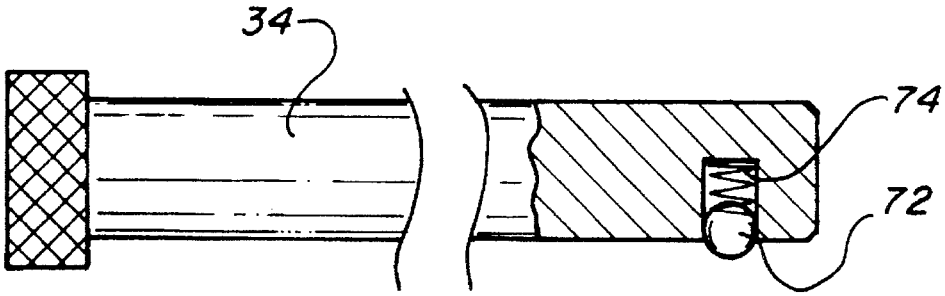
FIG. 7 is a view of one of the pins with the leading edge thereof shown in cross sectional configuration to show certain internal constructions thereof.

Lastly, as shown in FIG. 7, the pins are preferably formed to include a ball 72 extending partially through a peripheral surface of the pin adjacent to its outboard end. In addition, an internal spring 74 is provided to urge the ball radially outwardly into a locking orientation once positioned through the apertures and extending from the opposite side thereof.

When constructing a brick wall a bricklayer can easily lay the bricks up to a certain reachable height. Beyond that height a scaffold is required to continue the job. The present invention facilitates laying brick at a height above head level. It is designed for use in constructing walls up to 10 feet in height. The highest point of the scaffold is 6 feet.

Two 1 ½ inch steel tubes, approximately 6 feet tall, are installed perpendicular to two base plates and parallel to each other. Four short lengths of smaller steel tubing are installed horizontally between the two tubes, equally spaced from the bottom, and welded to them. The outer tube has a length of steel channel longitudinally secured to its outer edge. Four shorter lengths of 1 ½ inch tubing are welded together to form a rectangular frame. The outside leg of the frame is mounted perpendicular to a steel base plate. One of these frames is mounted to each side of the inner 6 foot tubing by means of strong hinges.

When in the open position, forming a "T" from above, the scaffold stands securely on four legs that are vertically adjustable to accommodate uneven terrain. When the frames are folded into the sides of the two taller structural members, the scaffold can be easily moved and set up in another location.

A removable section consisting of a length of 1 ¼ inch steel tubing mounted on a steel base plate, and a steel arm extending out horizontally to mount in the channel on the 6 foot tube, is added to the scaffold when the bricklayer has gone as high as he can at ground level. At that time, boards are placed on the removable section for the bricklayer to stand on while the bricks are placed on the scaffold boards on the higher section. The arm on the removable section is vertically adjustable.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved scaffolding for use by bricklayers when working at elevated locations comprising, in combination:

a plurality of scaffolding components adapted to support planking for use by bricklayers when working at elevated locations;

each of the scaffolding components comprising a central H-shaped member, the H-shaped member fabricated of a pair of vertically disposed hollow, tubular external vertical members in spaced parallel relationship, each external vertical member having a plurality of holes extending therethrough in aligned pairs for adjustment purposes, a plurality of cross rods disposed in a horizontal orientation coupling the external vertical members into a ladder like configuration;

an adjustment foot for each external vertical member, each adjustment foot having a planar member positionable in a horizontal plane on the ground and an upstanding, plurality of tubular internal vertical members positioned within each of the external vertical members and with apertures in aligned pairs adapted to align with the apertures of the external vertical members;

a pin positionable through aligned apertures of each internal vertical member and each external vertical member to vary the height of the H-shaped member;

support assemblies being formed in a rectangular configuration with an internal vertical leg and an external vertical leg and horizontal legs therebetween and with apertures in the external legs adjacent the lower end with support feet having a horizontal plate positionable on the ground and an interior vertical member extending upwardly therefrom with aligned apertures therethrough;

a pin extending through the apertures of the vertical legs to vary the height of the support assemblies, the horizontal legs of the support assemblies being of a length essentially equal to the length of the cross rods of the H-shaped member;

hinges coupling an internal vertical leg of each support assembly with an associated external vertical member of the H-shaped member; and a supplemental support post positionable in a vertical orientation with a horizontal support foot at the lower edge thereof, the supplemental vertical post being provided with plural aligned apertures for adjustment purposes and a cross piece having an internal and external end with a C-shaped coupler at its internal end with aligned apertures positionable with aligned apertures of an external member of the H-shaped member for adjustment therebetween and a box shaped coupled at its external end for the passage of the supplemental support post therethrough with aligned apertures and a supplemental pin for passage therethrough to vary the elevational orientation of the cross piece.

* * * * *